US006073815A

United States Patent [19]

Ponton

[11] Patent Number: 6,073,815

[45] Date of Patent: Jun. 13, 2000

[54] UNIT FOR PACKAGING AND DISPENSING A LIQUID OR SEMI-LIQUID PRODUCT

[75] Inventor: Thierry Ponton, Charenton le Pont, France

[73] Assignee: L'Oreal, Paris, France

[21] Appl. No.: 09/153,891

[22] Filed: Sep. 16, 1998

[30] Foreign Application Priority Data

Sep. 16, 1997 [FR] France ..... 97 11577

[51] Int. Cl.[7] ..... B65D 83/00

[52] U.S. Cl. ..... 222/402.21; 222/526

[58] Field of Search ..... 222/402.21, 402.13, 222/402.24, 526, 527; 239/337, 587.4

[56] References Cited

U.S. PATENT DOCUMENTS

| | | | |
|---|---|---|---|
| 3,149,761 | 9/1964 | Harris et al. . | |
| 3,731,847 | 5/1973 | Webster | 222/402.21 X |
| 4,450,984 | 5/1984 | Beard | 222/402.21 X |
| 4,978,035 | 12/1990 | Morane et al. | 222/402.13 X |
| 5,139,180 | 8/1992 | Lucas | 222/402.13 |
| 5,335,832 | 8/1994 | De Laforcade | 222/402.13 |

FOREIGN PATENT DOCUMENTS

| | | |
|---|---|---|
| 0385 863 | 9/1990 | European Pat. Off. . |
| 0556 128 | 8/1993 | European Pat. Off. . |
| 2261618 | 5/1993 | United Kingdom . |

*Primary Examiner*—Andres Kashnikow
*Assistant Examiner*—Sean P. O'Hanlon
*Attorney, Agent, or Firm*—Oblon, Spivak, McClelland, Maier & Neustadt, P.C.

[57] ABSTRACT

A unit for packaging and dispensing a product contained in a reservoir (12) is surmounted by a dispensing element (30) which has a hollow stem (33) mounted on elastic return element, and on which stem a member (34) for actuating the said dispensing element is mounted. The actuating member has a bearing surface (38). A coupling forming a ball joint (101) is provided between the hollow stem (33) and the push-button (34). The unit has a body (10) forming the reservoir (12) for the product, the product emerging through at least one orifice formed in an outlet member (9) connected to the dispensing element by a duct (41) forming a flexible coupling, and being held approximately motionless on a stationary portion (51) of the body surmounting the reservoir (12). The actuating member (34) is mounted independently of the stationary portion (51) of the body.

33 Claims, 4 Drawing Sheets

UNIT FOR PACKAGING AND DISPENSING A LIQUID OR SEMI-LIQUID PRODUCT

BACKGROUND OF THE INVENTION

1. Field of the invention

The present invention relates to a unit for packaging and dispensing a liquid or semi-liquid, or even highly viscous, product. It is especially suited to the packaging and spraying of liquid products (such as scents) used in the field of cosmetics or of dermo-pharmacology. The invention is specifically suited to devices with a manually operated pump.

2. Background of the Related Art

Devices for spraying liquid, either by means of a manually operated pump, or by means of a valve used in conjunction with a pressurized liquid, are well known. Typically, the valve or the pump is actuated by a push-button mounted on a hollow stem, which is mounted on elastic return means and is capable, under the effect of a pressure exerted on the push-button, of being depressed so as to place the passage defined inside the hollow stem in communication with the contents of the reservoir. This communication allows liquid to be dispensed through an outlet member connected to the said passage. When the pressure ceases, the hollow stem rises back up by elastic return, thus interrupting the dispensing of the product. The outlet member may consist of a nozzle or any other spray member such as a mesh, or a porous member, etc.

The effectiveness of the system, particularly the minimum force necessary for actuating the dispensing element (that is to say the efficiency), depends to a great extent on the way in which the actuating pressure is transmitted to the pump stem. This problem arises in particular when the force exerted on the push-button is not directed exactly along the axis of the stem but is offset, which causes a stress at the pump stem which has both a vertical component and a horizontal component. When there is a rigid coupling between the stem and the push-button, a slight jamming of the stem occurs. This impedes its correct retraction into the pump body and means that a greater bearing force has to be exerted in order to produce the stem depression needed to actuate the pump.

FR-A-2 692 235 describes a device for dispensing a liquid product comprising a container equipped at the top with a dispensing member bearing a push-button, and a cap fitted with an actuating member in the form of a lever articulated to the cap and equipped with a bearing means acting on the upper outer surface of the push-button, the articulation between the actuating member and the cap being situated, heightwise, halfway along the travel of the push-button. The upper outer surface of the push-button is a convex spherical surface, and the bearing means is a circular ring, the annular lower end of which defines a spherical bearing surface that complements that of the upper outer surface of the push-button.

Although the device described in this document is satisfactory in certain respects, it poses a certain number of problems. This is because the coupling between the push-button and valve stem is a fixed coupling as in conventional devices. Only the coupling between the bearing surface and the push-button is achieved by means of a connection in the form of a spherical surface against which a surface of complementary shape bears. This does not fully solve the problem of the jamming of the valve stem, which still partially remains, depending on the position at which the bearing force is applied to the bearing surface. Furthermore, because of its design, the system is complicated and expensive to produce. What is more, pump or valve actuation do not occur effectively unless the bearing force is exerted on a localized region of the bearing means, namely essentially opposite the articulation between the actuating member and the cap. Finally, because of the complexity of its design, the system is relatively fragile.

What is more, in the device described in the patent discussed above, the product-outlet nozzle is integral with the push-button. Thus, when the pump or valve is actuated, the push-button is depressed axially, as is the product-outlet nozzle. A problem then arises which is similar to the one which will now be described in greater detail with reference to a certain number of other documents of the prior art.

By way of example, utility certificate application FR 2,682,937 describes a spray device of the type with a pump, comprising a pump mounted on a bottle, and comprising a hollow stem which acts as an outlet duct and as an actuating member, and can move within the pump body against the action of a spring. A dispensing cap is mounted on the bottle on top of the pump, and comprises a pressure-actuated element equipped with means of mechanical coupling to the hollow stem. The cap also comprises a spray nozzle and an internal passage which opens into the nozzle, as well as connection means serving to place the hollow stem in communication with the internal passage in the cap. According to this document, the connection means comprise a flexible tubular element coupled at one end of the hollow stem and at the other end to the internal passage of the dispensing cap. To dispense some product, the pressure-actuated element is depressed, which causes actuation of the pump, and liquid to emerge through the outlet nozzle via the hollow stem, the flexible tubular element and the internal passage. Under the effect of the actuating pressure, the upper part of the cap carrying the nozzle flexes at a connecting region located beneath the nozzle.

The major drawback of a device of this kind stems essentially from the fact that actuating the pump causes a substantial change in the position of the nozzle (by pivoting), which change causes a change in orientation of the sprayed liquid. Inevitably, if no precautions are taken, the product will not be sprayed in the desired place. Another device of the same type, and therefore with the same drawbacks, is described in EP-A-0,747,131.

In EP-A-0,385,077, just as in FR-A-2,692,235, actuating the pump causes an axial movement of the outlet nozzle which, in the same way as for the device discussed earlier, has to be taken into account when positioning the spray device with respect to the surface to be treated, so that the product will be sprayed exactly in the desired place. Furthermore, such a design makes it necessary to produce an oblong orifice opposite the nozzle, the axial height of which orifice depends on the amplitude of the axial movement of the nozzle. Such an orifice of elongate shape has a not insignificant affect on the aesthetic appearance of the device.

U.S. Pat. No. 3,149,761 and EP-A-556,128 both describe a push-button mounted on a valve stem via a ball-joint connection. In both these documents, product is discharged essentially along the axis of the valve stem. If there is a desire to make the outlet orifice lateral, in particular, with respect to the axis of the container, then the same problem as described with reference to the devices discussed earlier, namely that of the movement of the outlet nozzle when the dispensing member is actuated, arises. The problem is all the more noticeable where manually operated pumps with an actuating travel of several mm are involved. In the case of a valve, the actuating travel at the time of opening is only a few hundredths of a millimeter.

SUMMARY OF THE INVENTION

It is therefore an object of the invention to provide a device for packaging and dispensing a product, especially by spraying, through an outlet member, the position of which is appreciably fixed, particularly when the dispensing element is actuated.

A further object of the invention is to provide a device with an improved aesthetic appearance, and which is simple and economical to produce on an industrial scale.

A further object of the invention is to provide a device that allows the actuation of the dispensing element to be optimized, irrespective of the position from which the bearing force is exerted on the bearing surface.

A further object of the invention is to provide a device that makes it possible to limit the force needed to actuate the dispensing element, particularly when the actuating force is not directed exactly along the axis of the dispensing element outlet stem.

According to the invention, these and other objects are achieved by a unit for packaging and dispensing a product contained in a reservoir surmounted by a dispensing element which has a hollow stem with axis A, on which stem a member for actuating the dispensing element is mounted, the actuating member comprising a bearing surface. A coupling forming a ball joint is provided between the hollow stem and the push-button so as to bring about, in response to a pressure exerted on the bearing surface off the axis of the hollow stem, a movement of the actuating member about the axis of the stem in a cone, the vertex of which is centered on the axis of the stem, and so as to transmit to the hollow stem a force which is directed essentially along the axis of the stem, so as to depress the hollow stem and dispense the product through an outlet member. The unit comprises a body with axis X, forming the reservoir for the product, the product emerging through at least one orifice formed in the outlet member, the outlet member being connected to the dispensing element by a duct forming a flexible coupling and being held approximately motionless on a stationary portion of the body surmounting the reservoir, the actuating member being mounted independently of the stationary portion of the body. The hollow stem may form an integral part of the dispensing element, or form part of the actuating member, in which case it is positioned in a corresponding housing of the dispensing element.

Thus, the only coupling between the outlet member and the moving actuating member is via a duct that forms a flexible coupling. The flexibility of the coupling essentially absorbs all of the movement of the actuating member so that when the pump or the valve is actuated, the outlet member, situated off the axis of the hollow stem, does not move appreciably. This characteristic, combined with the characteristic whereby the coupling between the push-button and the hollow stem is a coupling in the form of a ball-joint connection, essentially eliminates any movement of the outlet nozzle, the ball joint absorbing the angular difference with respect to the slight connecting-rod-type movement created by the downwards movement of the push-button.

Since the ball-joint connection is a direct connection between the push-button and the hollow stem, it allows a force applied off-axis to the bearing surface to be converted into a force which is essentially directed along the axis of the hollow stem. Any risk of jamming is thus avoided. The horizontal component of the force is negligible compared with the vertical component transmitted to the hollow stem. As a result, the compression loss on maneuvering between a push-button lying on the axis and a push-button which is inclined is negligible.

Advantageously, the dispensing element consists of a manually operated pump. With such a pump, the liquid contained in the reservoir is not pressurized, which pressurizing would not be compatible with certain products, especially scents.

The dispensing element may be offset from the axis X. This has proved particularly advantageous, particularly in the case of a pump stem with a long actuating travel, in order to provide a further improvement in the absorption of the movement of the actuating member by the flexible connection. Such a configuration allows the use of pumps with a longer actuating travel, and therefore a higher delivery.

Advantageously, the coupling forming a ball joint is formed of at least one portion of a sphere through which there passes a passage for mounting it on the stem, the sphere portion being situated inside a recess provided in the member and of which at least part is of a shape that complements that of the sphere, so as to produce a ball-joint connection between the hollow stem and the push-button. The sphere portion is advantageously arranged symmetrically with respect to the axis of the hollow stem.

According to a particular embodiment, the sphere is held in position in the recess by snap-fastening or by crimping. Purely by way of illustration, the sphere is made of plastic (polypropylene, high-density polyethylene, etc.) or of metal. Advantageously, the cone in which the axis of the push-button moves has a cone angle of from 5° to 25°, preferably from 5° to 15°. Advantageously, the outlet member is a nozzle for spraying a liquid product, such as a scent. Such a nozzle is of known configuration, and therefore needs no detailed description.

According to one embodiment, the body comprises a transverse partition separating a first volume which defines the reservoir from a second volume surmounting the first, the second volume containing the dispensing element mounted on an orifice formed in the partition, the actuating member mounted on the dispensing element, the outlet member and the duct that forms the said flexible coupling.

Advantageously, the outlet nozzle is arranged approximately motionless in the bottom of a cut-out formed in a side wall of the second volume, the cut-out opening to a free edge of the second volume, situated away from the transverse partition. The nozzle can better be held motionless in the bottom of the cut-out (and in particular its position at right-angles to the axis of the device can be improved) by providing, on the inside of the side wall, in line with the bottom of the cut-out, an increased thickness of material which increases the width of the nozzle support.

The outlet member may be mounted inside a chamber in communication with the duct forming the flexible coupling, the actuating member, the chamber and the flexible duct forming a single piece and being obtained by molding of a thermoplastic. As as example, the thermoplastic is a low-density polyethylene (LDPE), or a low-density polyethylene (LDPE)/high-density polyethylene (HDPE) mix with an HDPE content at most equal to 25% of the mix. Such a characteristic plays a part in appreciably reducing the cost of manufacturing the unit.

Assuming that the actuating member is obtained by molding, the bearing surface on which the actuating pressure is exerted consists of an attached part. This makes releasing the actuating member from the mold easier. The attached part may be mounted by snap-fastening, bonding or welding.

According to another embodiment, the duct forming the flexible coupling forms a bellows. This is particularly advantageous when the nature of the product to be dispensed requires the connecting duct to be made of a material which does not have a sufficient inherent flexibility. In this case, this lack of flexibility is overcome by giving the duct a flexible configuration.

According to a preferred embodiment, the body is formed as a single piece. For example, the body may be obtained by molding a thermoplastic chosen from polypropylenes (PP), polyethylene terephthalates (PET), etc. The thermoplastic may be introduced into the mold by injection.

The outlet member, in a particular embodiment, lies essentially at the same level as the free end of the hollow stem. In actual fact, it may be placed practically anywhere with respect to the free end of the pump or valve stem. It may, in particular, be placed below the free end of the pump stem, thus reducing the axial height of the unit.

According to another advantageous characteristic of the invention, the second volume has an end away from the partition, said end being closed by a protective element, of which at least part situated opposite the actuating member consists of a flexible material so that the actuating member can be actuated through the protective element. This protective element makes it possible to produce a closed unit which is remarkably aesthetic. Furthermore, this protective element plays a part in forming an enclosed unit, preventing any risk of soiling resulting from indented regions which are difficult to access for cleaning, and in which liquid could become deposited inadvertently. What is more, this protective element may also play a part in keeping the outlet member in a fixed position with respect to the body of the device.

Such a protective element may comprise a body in the form of a rigid or semi-rigid annular part, the protective element being held in position on the end of the second volume via an external covering that covers the unit over approximately its entire height, an orifice being formed in the external covering opposite the outlet member, the external covering having, opposite the end of the second volume, an end wall which has a cut-out opposite the actuating member. Advantageously, marking means of the error-proofing type, may be provided in order to allow the covering to be positioned in the correct angular position with respect to the rest of the body.

The rigid or semi-rigid annular part may comprise a tab portion, the free end of which is intended to rest against the outlet nozzle so as to immobilize the latter in the bottom of the cut-out. Such an arrangement allows a simple and economical assembly of the unit, as well as allowing the outlet nozzle to be held firmly in an immobile position.

The covering may, at least near one end of the first volume farthest from the partition, grip tightly onto the body of the unit. The gripping may be achieved by axial grooves formed on the outer surface of the body and/or on the inner surface of the covering. The covering may be made of metal or of plastic. The covering may be mounted on the body in any appropriate way. By way of example, the covering may be screwed, welded or snap-fitted onto the body.

The protective element may be formed by two-shot injection of two compatible materials, a first, rigid or semi-rigid, material forming the annular part and a second, flexible material forming the part located opposite the actuating member. Two compatible materials are understood as meaning two materials which, at the injection temperature, are capable of forming physico-chemical bonds with each other. By way of illustration, the first material is a polypropylene (PP), or a high-density polyethylene (HDPE), the second material being SEBS.

According to a preferred embodiment, the reservoir has an attached end wall, mounted in a sealed manner on the body. This is particularly advantageous in cases where the body of the unit is obtained by molding, as a single piece. Furthermore, it allows the reservoir to be filled from the bottom. The attached end wall may have an orifice for filling the reservoir, the orifice being closed off after filling by a blanking element. This orifice, of a limited diameter compared with the cross-section of the reservoir, allows a considerable reduction in the risk of product overflowing and being lost over the top edge of the reservoir during jerky handling of the product-filled unit by industrial tools before the bottom of the reservoir is closed.

Advantageously, sealing is provided in at least two axially offset regions. A first sealing region may be produced by at least one snap-fitting bead. The second sealing region may be produced by tightly mounting a portion of the end wall attached to the internal walls of the body.

Advantageously too, a third sealing region is produced between the first two, the third sealing region being produced by an 0-ring seal placed in the bottom of a groove formed in a side wall of the attached end wall. Such a seal may be made of a material such as a butyl or an EPDM (ethylene propylene diene terpolymer). The attached end wall may, for its part, be made of a material selected from polypropylenes (PP), polybutylene terephthalates (PBT), high-density polyethylenes (HDPE), etc.

The product may be a pharmaceutical, dermo-pharmaceutical or cosmetic product, especially a scent.

BRIEF DESCRIPTION OF THE DRAWINGS

Apart from the arrangements explained hereinabove, the invention consists in a certain number of other arrangements which will be explained hereafter, in relation to non-limiting embodiments which are described with reference to the appended drawings, among which.

DETAILED DESCRIPTION OF THE PREFERRED EMBODIMENTS

Figure 1A:
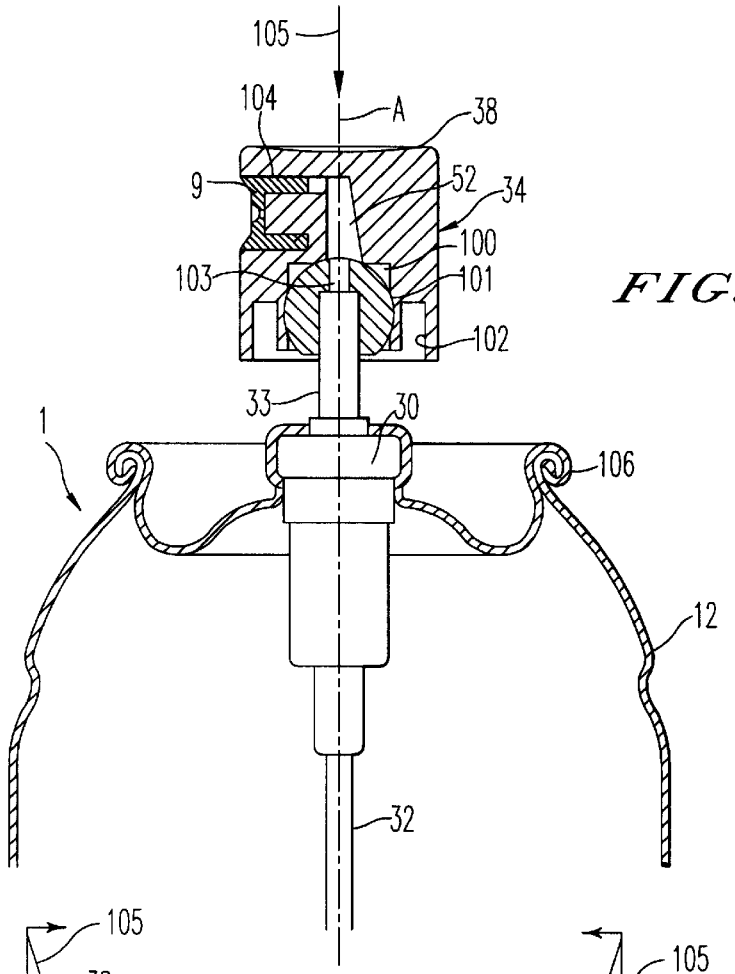
FIGS. 1A–1C illustrate, in a simplified way, the ball-joint coupling used in the unit according to the invention.

FIGS. 1A–C and 2 depict various views of a device which does not fall within the scope of the invention, but which is useful to explain the ball-joint coupling used according to the invention. The unit illustrated comprises a reservoir 12 in the form of a can for example, and the neck 106 of which is surmounted by a valve 30 which may be crimped to the free edge of the neck 106. The valve 30 opens to the outside of the reservoir via a valve stem 33 which is mounted on elastic return element (not depicted) that returns the valve stem to the closed position when no actuating pressure is exerted on the push-button 34. The valve stem 33 has an axis A. Inside the can 12, a dip tube 32 is connected to the valve for conveying the pressurized product (by means of a non-liquefiable gas, for example), into the valve via the tube 32. The valve is of well-known structure and therefore requires no further description.

Figure 2:
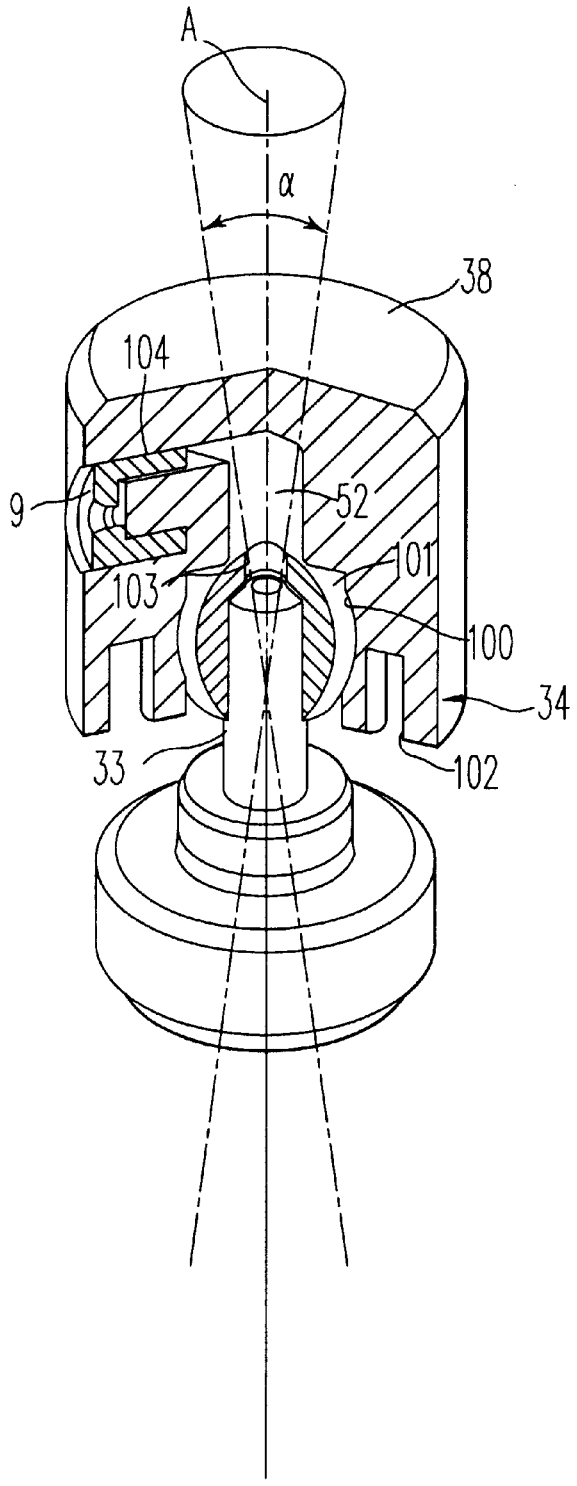
FIG. 2 is a view with cutaway of the actuating member of FIGS. 1A–1C.

Mounted on the valve stem 33 is a push-button 34 having a bearing surface 38 on which the user exerts pressure in order to actuate the valve or the pump 30 and cause product contained in the reservoir 12 to exit. The bottom of the push-button has a recess 100, the shape of which at least partially complements that of a member 101 which essentially forms a sphere (with the exception of its bottom which is slightly truncated), and which is arranged inside the recess. The sphere has a through passage 103 in which the valve stem 33 is force-fitted. The sphere is held in the recess 100 by snap-fitting. Inside the recess, it acts like a ball joint to allow the push-button to pivot about the axis A. The axis of the push-button can move within a cone centered on the axis A. This cone is illustrated in FIG. 2. In actual fact the movement of the axis of the push-button defines a double cone. The two cones are identical and aligned on the axis A of the stem, their respective vertices being coincident with the center of the sphere 101. The cone angle a of the cones is from 5° to 25°, and preferably from 5° to 15°.

The recess 100 is extended by a duct 52, the mouth of which is large enough that, irrespective of the angular position of the push-button, the outlet orifice of the passage 103 communicates with the duct 52 so as to allow product to be dispensed via the valve stem 33, the internal duct 52, and an outlet nozzle 9. The outlet nozzle 9 is situated inside an annular recess 104 in fluid communication with the duct 52 and is oriented so as to allow product to emerge sideways and, preferably, essentially at right-angles to the axis of the device. Advantageously, in order to reduce the size of the mouth of the duct 52, the valve stem 33 is force-fitted into the passage 103 of the ball over approximately two-thirds of the height of the ball. Over this portion, the cross-section of the passage slightly exceeds the outside diameter of the valve stem 33. Over the upper third, the cross-section of the passage is smaller, and is essentially equal to the inside diameter of the hollow stem.

Figure 1C:
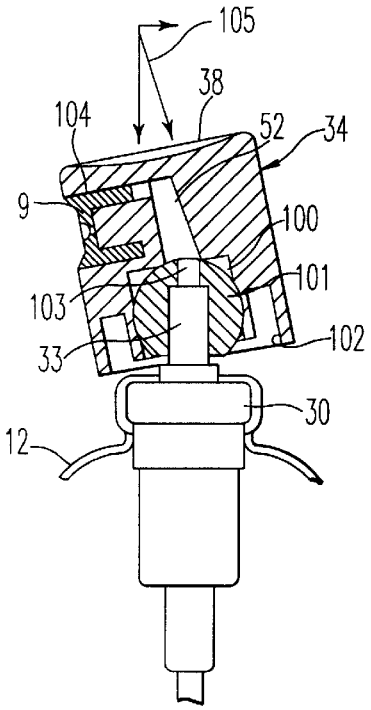
Figure 1B:
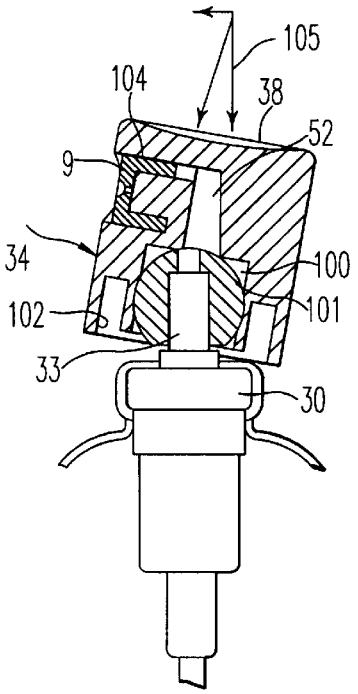

The push-button 34 has, near its lower edge, an annular recess 102 allowing the valve stem to be depressed sufficiently when the push-button is in an inclined position as depicted in FIGS. 1B and 1C.

In FIG. 1A, the actuating force, illustrated by the arrow 105, is centered on the axis A of the stem. In this case, the push-button remains centered on the axis A. Essentially all of the bearing force is then transmitted to the valve stem in the form of a practically vertical force along the axis of the stem 33.

In the position illustrated in FIG. 1B, the actuating force is offset from the axis of the valve stem. The push-button is in a slightly inclined position with the nozzle oriented upwards. The force 105 thus has a vertical main component and a horizontal minor component (oriented towards the outlet nozzle). The force exerted on the stem, because of the ball-joint connection formed by the ball 101 in the recess 100, is exerted along the axis of the stem. The stem is depressed axially, essentially without lateral or radial stress. There is therefore no jamming liable to affect the operation of the valve.

In the position illustrated in FIG. 1C, the actuating force is offset from the axis of the valve stem. The push-button is in a slightly inclined position with the nozzle oriented downwards. The force 105 thus has a vertical main component and a horizontal minor component (oriented away from the outlet nozzle). The force exerted on the stem, because of the ball-joint connection formed by the ball 101 in the recess 100, is exerted along the axis of the stem. The stem is depressed axially without lateral or radial stress. There is therefore no jamming liable to affect the operation of the valve.

As is evident from the foregoing discussion, the tilting of the push-button about the ball joint also causes a corresponding tilting of the outlet nozzle. This tilting is not a problem in the case of a valve in which the actuating travel is small (a few hundredths of a millimeter). By contrast, it becomes very troublesome in the case of a pump in which the actuating travel is typically of the order of a few mm.

Figure 3:
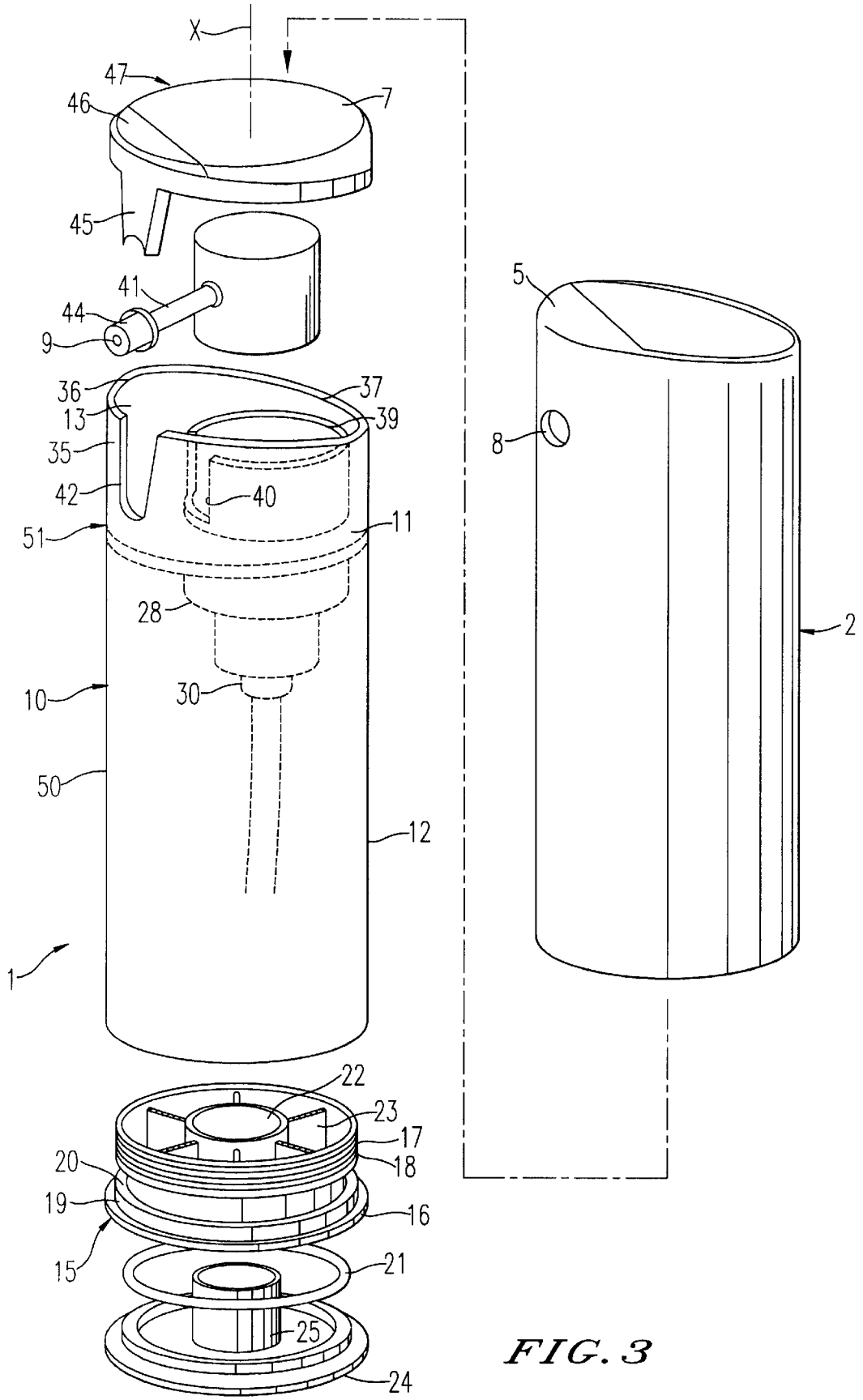
FIG. 3 is an exploded view of a preferred embodiment of the unit according to the invention.
Figure 4A:
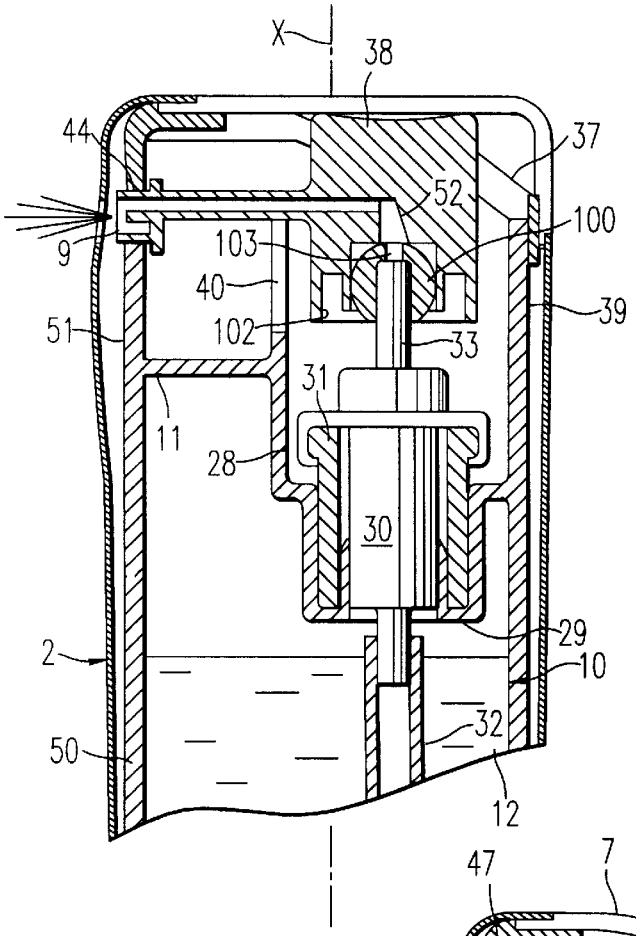
FIGS. 4A–4B illustrate the operation of the unit depicted in FIG. 3.
Figure 4B:
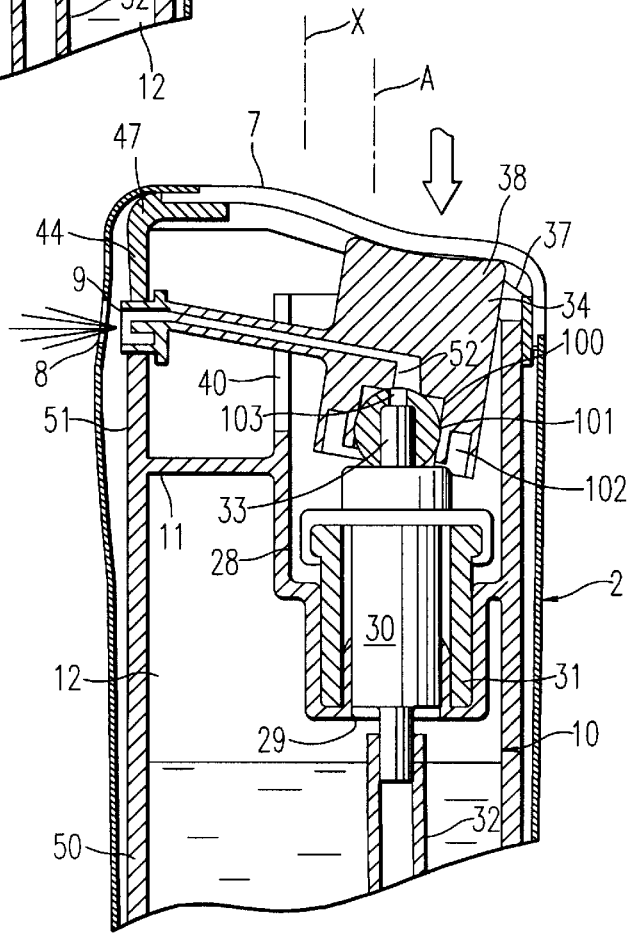

FIGS. 3 and 4A–4B illustrate in detail a preferred embodiment of the device according to the invention. The device comprises a cylindrical body 10 comprising two parts 50, 51 separated by a transverse wall 11. The transverse wall delimits, at the bottom 50 of the body, a first volume 12 forming a reservoir for the product to be dispensed, and at the top 51 of the body, a second volume 13 containing, as will be seen in greater detail later, all the elements necessary for dispensing the product.

The body is formed as a single molded piece (injection molding for example) of a material which, advantageously, is polyethylene terephthalate. The lower end 14 of the body 10 is closed off by an attached end wall 15. The attached end wall 15 comprises a first annular portion 17, the outer surface of which is equipped with several ribs or ridges 18 capable of interacting by snap-fastening with corresponding ribs formed on the interior surface of the body 10 near its lower end 14. The end wall 15 has a second annular portion 19 capable of being forcibly engaged in the opening delimited by the free edge of the body 10. A groove 20 is situated between the two annular portions 17, 19, to accommodate a butyl O-ring 21 in order to improve the sealing of the fitting of the end wall 15. The end wall 15 also has a central orifice 22 through which the reservoir 12 is filled after the attached end wall 15 has been fitted. Fins 23 are situated radially in the volume formed by the end wall 15 so as to stiffen its structure. The central orifice is closed off by a plug 24 comprising an axial part 25 of an outside diameter essentially equal to the inside diameter of the orifice 22, and a transverse wall 26 of an outside diameter essentially equal to the outside diameter of the body 10. The plug is held by force or by snap-fastening in the orifice. A part 16, with an outside diameter essentially equal to the outside diameter of the body 10 is situated beneath the annular portion 19 so as to limit the depth to which the plug 24 can be driven into the body. Once fitted the plug 24 defines with the attached end wall 15 an annular space in which an annular weight (not depicted) may be placed.

The transverse wall 11 forms a recess 28, in the bottom of which an orifice 29 is formed for mounting a pump 30. As is clearly evident from FIGS. 4A and 4B, the recess 28 and the orifice 29 are offset from the axis X of the device. The pump is advantageously mounted in the recess 28 in the way described in detail in FR 2,669,244, that is to say via an annular intermediate piece 31, to the free edge of which the pump 30 is crimped. During assembly, the pump 30 is first crimped to the intermediate piece 31. The unit is then snap-fitted in the recess 28 through the orifice 29. A dip tube 32 descends down into the reservoir 12, its free end being situated essentially near the end wall 15 of the reservoir.

The pump 30 has a hollow pump stem 33, the free end of which emerges in the upper volume 13 delimited by the transverse wall 11. At its upper end 35, the free edge of the body 10 is straight over approximately one third of its cross-section 36 (the front part of the body) and cut off at an angle over the rest of its cross-section 37 (the rear part of the body). Mounted on the free end of the stem 33 is a push-button 34, a bearing plate 38 of which emerges from the cut-off edge 37 and is located essentially level with the straight-edge portion 36. The push-button 34 is arranged in a hollow tube 39 which extends the upper part of the recess 28. The manually operated pump is entirely conventional and in consequence requires no detailed description.

Like the push-button discussed with reference to FIGS. 1A–1C and 2, the push-button comprises, inside a recess 100, a ball 101 made of metal or of plastic and held in the recess by snap-fastening. The ball is pierced with a through passage 103 capable of accommodating, by force, the outlet stem 33 of the pump, so as to provide the ball-joint connection discussed earlier.

The hollow tube 39 has a cut-out 40 for the passage of a flexible duct 41 connecting an internal passage 52 formed in the push-button to an outlet nozzle 9 mounted in a chamber 44 and held motionless in the bottom of a cut-out 42 which opens to the straight-edge portion 36 of the body 10. The cut-out 42 is situated essentially facing the cut-out 40. The outlet nozzle 9 faces laterally with respect to the axis of the pump.

The duct 41 has characteristics of suppleness and flexibility, even elasticity, which are such that when combined with the ball-joint connection between the push-button 34 and the hollow stem, the movement of actuating the push-button causes essentially no movement of the outlet nozzle 9. This is because the ball joint 101 absorbs the angular difference with respect to the connecting-rod-type movement created by the downwards movement of the push-button 34.

According to a preferred embodiment, the duct 41, the chamber 44 and the push-button 34 are molded as a single piece, made of low-density polyethylene. The bearing plate 38 is attached and mounted by snap-fastening onto the push-button 34. The bearing plate is made of a more rigid material than the material that forms the rest of the push-button. Advantageously, the bearing plate 38 is made of high-density polyethylene or of polypropylene. The outlet nozzle 9 is an acetal component force-fitted into the chamber 44.

As is clear from FIG. 4B, the movement of actuating the push-button 34 results in a movement of the flexible duct 41, which movement may be accompanied by lengthening of the duct, particularly in the case of an elastomeric material or if at least part of the duct forms a bellows. This flexible connection between the outlet nozzle 9 and the push-button absorbs most of the movement of the push-button, thus isolating the nozzle from the said push-button. The outlet nozzle is then almost insensitive to the movements of actuating the push-button 34. As is clearly evident, the axial movement of the furthest part of the flexible duct 41 from the outlet nozzle 9 is limited by the tilting movement caused by the ball-joint connection between the push-button and the pump stem in response to a bearing force exerted offset from the axis of the hollow stem, thus isolating the nozzle 9 from the push-button still further. Thus, because of the flexible connection between the outlet nozzle and the push-button, and because of the ball-joint connection between the push-button and the pump or valve stem, the outlet member is approximately motionless when the push-button is actuated.

Other materials or arrangements may be used for producing the flexible coupling between the push-button 34 and the outlet nozzle 9. By way of example, the duct 41 may be made of an elastomeric material (SEBS, EPDM).

The outlet nozzle 9 is arranged inside a chamber 44 extending the flexible duct 41 and is kept motionless in the bottom of the cut-out 42 by a tab 45 borne by the annular body 46 of a protective element 47. The annular body 46, made for example of polypropylene, has a profile which overall follows the profile of the edge of the upper end 35 of the body 10. The opening delimited by the upper edge of the annular body 46 is closed off by a flexible membrane 7 intended to be positioned opposite the push-button 34. The flexible membrane is advantageously made of SEBS (styrene-ethylene-butadiene block copolymer) and may be produced by two-shot injection with the polypropylene carcass. During assembly, the protective element is placed on the upper end 35 of the body 10, the inside diameter of the annular body 46 being slightly larger than the outside diameter of the body 10. The tab 45 comes to rest on the upper part of the chamber 44 containing the nozzle 9, which is thus immobilized. The chamber 44, and therefore the nozzle 9, can better be kept motionless by providing on the internal wall of the upper volume 13 an increased thickness of material in line with the bottom of the cut-out 42, so as to ensure better positioning of the chamber 44.

The unit thus described is intended to be mounted inside an external covering 2, made of aluminum for example. The end wall 5 of the external covering has a cut-out of a similar profile to the cut-out of the upper end 35 of the body 10, and to the cut-out formed by the upper edge of the annular body 46 of the protective element 47. The shape of the cut-out 6 in the external covering 2 is such that it essentially coincides with the flexible membrane 7 of the protective element 47. An orifice 8 is formed in the external covering 2 opposite the outlet nozzle.

The unit is assembled as follows. First the pump is mounted in the orifice 29. The body 10 is then inverted and filled from the bottom through the orifice 22, which is then closed off with the plug 24. The ball 101 is then snap-fastened inside the recess 100 of the push-button 34 which, together with the flexible duct 41 and the outlet nozzle 9 are positioned inside the chamber 44 and mounted on the pump outlet stem 33, the outlet stem 33 being force-fitted into the passage 103 that passes through the ball 101. The protective element 47 is then placed over the upper end 35 of the body and the external covering is slipped over the unit, marking means (of the axial groove type) ensuring correct angular positioning of the body relative to the external covering 2. The body 10 has a cross-section that increases slightly towards its lower end 14 so that at least near its lower end 14, the body is gripped tightly inside the external covering 2. In the assembled position, as is clearly evident from FIGS. 4A and 4B, the lower edge of the protective element 47 is held between the external wall of the body 10 and the internal wall of the covering 2. The device is then ready to be used.

Alternatively, it is possible to fit the protective element alone in the covering 2, via the cut-out 6, then to mount the body of the device inside the covering.

In the foregoing detailed description, reference was made to preferred embodiments of the invention. It is obvious that variations may be made thereto without departing from the spirit of the invention as claimed hereafter.

What is claimed is:

1. A unit for packaging and dispensing a product, comprising:

a body enclosing a reservoir for the product;

a dispensing element surmounting said body and having a hollow stem;

an actuating member comprising a bearing surface;

a ball joint coupling said hollow stem and said actuating member such that said actuating member is mounted for movement about an axis of the hollow stem within a cone whose vertex is centered on the axis of the hollow stem, wherein said actuating member is in fluid communication with product dispensed from said hollow stem, via said ball joint, upon application of a force to said bearing surface;

an outlet member substantially immovably mounted to a portion of the unit which is independent of movement of said actuating member; and a flexible coupling fluidically coupling said outlet member to said actuating member such that movement of said actuating member does not cause substantial movement of said outlet member.

2. The unit according to claim 1, wherein the dispensing element comprises a manually operated pump.

3. The unit according to claim 1, wherein said dispensing element is offset from an axis of said body.

4. The unit according to claim 1, wherein said ball joint comprises at least a portion of a sphere having a through passage capable of accommodating said hollow stem, said sphere portion being mounted within a recess of said actuating member.

5. The unit according to claim 4, wherein said sphere is snap-fastened in the recess.

6. The unit according to claim 4, wherein said sphere is made of plastic.

7. The unit according to claim 4, wherein said sphere is crimped in the recess.

8. The unit according to claim 4, wherein said sphere is made of metal.

9. The unit according to claim 1, wherein the cone has a cone angle of from 5° to 25°.

10. The unit according to claim 1, wherein said outlet member comprises a nozzle for spraying a liquid product.

11. The unit according to claim 1, wherein said body includes a transverse partition separating a first volume of the body which defines said reservoir from a second volume of the body which surmounts the first volume, said transverse partition including a recess for holding the dispensing element in said second volume, said second volume also having the actuating member, the outlet member and the flexible coupling.

12. The unit according to claim 11 wherein the outlet member is arranged in a bottom of a cut-out formed in a side wall of the body at the second volume, the cut-out extending to a free edge of the side wall situated away from the transverse partition.

13. The unit according to claim 11, wherein the side wall of the body at the second volume has an end away from said partition, further comprising a protective element closing said end of said side wall, wherein at least part of said protective element faces the actuating member and comprises a material having flexibility such that said actuating member can be actuated via said protective element.

14. The unit according to claim 13, wherein the protective element further comprises a substantially rigid annular part, further comprising an external covering enclosing the unit over approximately an entire height thereof and holding said protective element on said end of the side wall, said external covering having an orifice facing the outlet member and a cut-out facing the actuating member.

15. The unit according to claim 14, wherein at least a part of the covering near an end of the first volume away from said partition grips tightly onto said body.

16. The unit according to claim 14, wherein the protective element is formed by two-shot injection of a first substantially rigid material forming the annular part, and a second flexible material forming the actuating member.

17. The unit according to claim 16, wherein the first material is one of a polypropylene and a high-density polyethylene, the second material being a styrene-ethylene-butadiene block copolymer.

18. The unit according to claim 11, wherein the first volume has an end away from the said partition, and an attached end wall mounted in a sealed manner on the body so as to close said end.

19. The unit according to claim 18, wherein said attached end wall has an orifice for filling the reservoir, said orifice being closed off after filling.

20. The unit according to claim 18, wherein said attached end wall has two axially offset sealing regions.

21. The unit according to claim 20, wherein a first of said sealing regions is comprised by at least one snap-fitting bead, and wherein a second of said sealing regions is comprised by a tight mounting fit.

22. The unit according to claim 21, further comprising a third sealing region provided between the first and second sealing regions, said third sealing region comprising an O-ring seal placed in a bottom of a groove formed in a side wall of the attached end wall.

23. The unit according to claim 22, wherein said O-ring seal is made of one of a butyl or an ethylene propylene diene terpolymer.

24. The unit according to claim 18, wherein the attached end wall is made of a material selected from polypropylenes, polybutylene terephthalates and high-density polyethylenes.

25. The unit according to claim 1, wherein the outlet member is mounted inside a chamber in communication with the flexible coupling, and wherein the actuating member, the chamber and the flexible coupling form a single molded thermoplastic piece.

26. The unit according to claim 25, wherein the bearing surface of the actuating member is formed as an attached element.

27. The unit according to claim 25, wherein said single molded thermoplastic piece is one of a low-density polyethylene, and a low-density polyethylene/high-density polyethylene mix with a high-density polyethylene content at most equal to 25% of the mixture.

28. The unit according to claim 1, wherein said flexible coupling forms a bellows.

29. The unit according to claim 1, wherein said body is formed as a single piece.

30. The unit according to claim 1, wherein the product is one of a pharmaceutical, dermo-pharmaceutical and cosmetic product.

31. The unit according to claim 1, wherein the cone has a cone angle of from 5° to 15°.

32. A unit for packaging and dispensing a product, comprising:

a body enclosing a reservoir for the product;

a dispensing element surmounting said body and having a hollow stem;

an actuating member comprising a bearing surface;

a joint element configured to pivotally couple said hollow stem and said actuating member, wherein said actuating member includes a passage in fluid communication with a product dispensed from said hollow stem, via said joint element, upon application of a force to said bearing surface;

an outlet member substantially immovably mounted to a portion of the unit which is independent of movement of said actuating member; and a coupling part mounted to fluidically couple said outlet member to the passage of said actuating member such that movement of said actuating member does not cause substantial movement of said outlet member.

33. A unit for packaging and dispensing a product, comprising:

a body enclosing a reservoir for the product;

a dispensing element surmounting said body and having a hollow stem;

an actuating member comprising a bearing surface;

joint means for pivotally coupling said hollow stem and said actuating member, wherein said actuating member includes a passage in fluid communication with a product dispensed from said hollow stem, via said joint means, upon application of a force to said bearing surface;

an outlet member substantially immovably mounted to a portion of the unit which is independent of movement of said actuating member; and coupling means for fluidically coupling said outlet member to the passage of said actuating member such that movement of said actuating member does not cause substantial movement of said outlet member.

* * * * *

UNITED STATES PATENT AND TRADEMARK OFFICE

CERTIFICATE OF CORRECTION

PATENT NO. : 6,073,815

DATED : June 13, 2000

INVENTOR(S): Thierry PONTON

It is certified that an error appears in the above-identified patent and that said Letters Patent is hereby corrected as shown below:

On the title page, item [30], the Foreign Application Priority Data should read as follows:

[30] Foreign Application Priority Data

Sep. 17, 1997 [FR] France ..... 97 11577

Signed and Sealed this

First Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,073,815
DATED : June 13, 2000
INVENTOR(S) : Thierry Ponton

It is certified that error appears in the above-identified patent and that said Letters Patent is hereby corrected as shown below:

Column 1,
Line 5, change “invention” to -- Invention --.

Column 2,
Line 55, change “U.S. Pat. No. 3,149,761” to -- US-A-3,149,761 --.

Column 4,
Line 54, second occurrence change “as” to -- an --.

Column 6,
Line 21, change “0-ring” to -- O-ring --.

Column 7,
Line 16, change “a” to -- *a* --.

Column 11,
Line 40, insert -- , -- after “11”.

Signed and Sealed this

Eighteenth Day of September, 2001

*Attest:*

Nicholas P. Godici

*Attesting Officer*

NICHOLAS P. GODICI
*Acting Director of the United States Patent and Trademark Office*